US005636535A

United States Patent [19]

Shimada

[11] Patent Number: 5,636,535

[45] Date of Patent: Jun. 10, 1997

[54] TAG COVER OF COMPACT DISK FOR PREVENTION OF SHOPLIFTING

[75] Inventor: Tomoharu Shimada, Edogawa-ku, Japan

[73] Assignee: Soft Service Inc., Tokyo, Japan

[21] Appl. No.: 272,544

[22] Filed: Jul. 11, 1994

[30] Foreign Application Priority Data

Nov. 12, 1993 [JP] Japan ..... 5-283132

[51] Int. Cl.[6] ..... E05B 65/00

[52] U.S. Cl. ..... 70/57.1; 206/1.5; 206/387.11; 70/63

[58] Field of Search ..... 70/14, 18, 19, 70/57.1, 58, 63; 24/704.1, 704.2, 706.8, 707.1; 206/1.5, 387.1, 309–313, 387.11

[56] References Cited

U.S. PATENT DOCUMENTS

| | | | |
|---|---|---|---|
| 3,933,240 | 1/1976 | Humble | 70/63 X |
| 4,718,547 | 1/1988 | MacTavish | 206/309 |
| 4,805,769 | 2/1989 | Soltis et al. | 206/309 |
| 4,819,797 | 4/1989 | Holmgren | 206/387.11 X |
| 4,871,065 | 10/1989 | Hehn et al. | 206/387 |
| 5,039,982 | 8/1991 | Bruhwiler | 206/1.5 X |
| 5,079,540 | 1/1992 | Narlow et al. | 70/57.1 X |
| 5,147,034 | 9/1992 | Broadhead et al. | 206/1.5 |
| 5,209,086 | 5/1993 | Bruhwiler | 70/57.1 |
| 5,211,283 | 5/1993 | Weisburn et al. | 206/1.5 |
| 5,289,914 | 3/1994 | Holmgren | 206/309 X |
| 5,297,672 | 3/1994 | MacTavish | 206/1.5 |
| 5,316,144 | 5/1994 | Habelt | 206/1.5 X |
| 5,349,331 | 9/1994 | Sieber et al. | 340/572 |
| 5,375,712 | 12/1994 | Weisburn | 206/1.5 X |
| 5,390,515 | 2/1995 | Essick | 70/57.1 X |
| 5,428,875 | 7/1995 | Nguyen et al. | 70/57.1 X |

FOREIGN PATENT DOCUMENTS

| | | | |
|---|---|---|---|
| 2688483 | 9/1993 | France | 206/387.11 |
| 3015294 | 8/1993 | WIPO | 70/57.1 |

*Primary Examiner*—Suzanne L. Dino
*Attorney, Agent, or Firm*—Longacre & White

[57] ABSTRACT

A new small sized tag cover for a compact disk to prevent shoplifting is developed. The shoplifting prevention tag is not easily damaged or removed from the compact disk housing case. Therefore, the compact disk is prevented from being stolen. The shoplifting prevention tag is recycled for subsequent use. The tag cover is comprised of a first connecting portion having a first engagement piece to be inserted into a first groove of a lid portion of the compact disk housing case. A second connecting portion having a second engagement piece is provided to be inserted into a second groove of the lid portion. A connecting portion is provided to retain the housing case in closed condition by clamping the housing case together with the first and second engagement pieces. A locking mechanism is provided to retain the lid portion in a closed condition. The shoplifting prevention tag is attached to either the first engagement portion, second engagement portion or the connecting portion so that the tag is not easily removed.

6 Claims, 11 Drawing Sheets

TAG COVER OF COMPACT DISK FOR PREVENTION OF SHOPLIFTING

BACKGROUND OF THE INVENTION

1. Field of the Invention

This invention relates to a tag cover for a compact disk for the prevention of shoplifting in sales stores or rental shops. The tag cover is provided to a compact disk housing case and the compact disk housing case, with the tag cover, possesses an electric wave or electromagnetic detection system for prevention of shoplifting in sales stores or rental shops of compact disks.

2. Description of the Prior Art

In the early days of compact disks, sales stores or rental shops of compact disks (hereinafter called as CD) adopted devices for preventing shoplifting. These devices sometimes possess an electric wave or electromagnetic detection system. These devices are designed to react to a shoplifting event. Consequently, when a customer passes through an entrance or exit of the sales store or rental shop, taking the CD and shoplifting prevention tag with him, a warning signal is issued. Therefore, most sales stores or rental shops of CDs adopted the shoplifting prevention tags to attach to each of the CD goods displayed. A clerk removes the shoplifting prevention tag when the customer wishes to purchase the CD. In such a way, the sales store or rental shop can succeed in preventing the CD from being shoplifted.

In former days, most sales stores of CDs stuck the shoplifting prevention tag on the wrapping paper of the CD housing case or inserted the tag inside the wrapping paper of the CD housing case.

However, in sales stores there occurred a problem that the store endured a large amount of running cost because the shoplifting prevention tags were stuck on the wrapping papers of the CD housing case and they were not recycled for next use. Furthermore, it is easy to strip off the tags from the wrapping papers and sometimes the tags are damaged. These matters easily lead some customers to shoplifting. The tags are recycled only if the tags are put into the wrapping papers. However, this way adversely stimulates shoplifting and is not recommended for the prevention of CDs from being stolen.

There occurred similar problems in rental shops where the shoplifting prevention tag was directly stuck on the CD housing case or just inserted into the CD housing case. In particular, the CD housing case is not wrapped in rental shops, thus it is easy to take out the CD from the CD housing case to shoplift. Some rental shops tried to wrap the CD housing case with paper and insert the tag inside the wrapping paper. However, taking into consideration working time to wrap the CD housing case with paper as well as the cost of wrapping materials, there was a problem that a great amount of running cost was endured.

It is known in the prior art to use a large case to house the whole CD housing case. This embodiment requires a specially devised tool to open the large case. Further, there is a problem that larger space is required in the receiving counter to store larger cases. Also there is another problem that displaying space must be enlarged.

This problem will reduce the number of CD goods to be displayed in the store. In Japan it is sometimes difficult to house such larger cases in the display rack of the shop.

Accordingly, the present invention is made in view of the aforementioned problems. The object of the present invention is to offer a small sized tag cover for a compact disk for the prevention of shoplifting. According to the small sized tag cover of the present invention, the tag cover is not easily removed or damaged, and therefore, the the CD is not easily stolen. Further, the tag is recycled for subsequent use.

SUMMARY OF THE INVENTION

In order to solve the aforementioned problems and to achieve the object of the present invention, the CD tag cover according to the present invention is provided to a CD housing case and comprises an electric wave or electromagnetic device. The main body and lid portions of the housing case are closed together to prevent the CD from being stolen from the CD housing case. The device comprises: a first engagement portion having a first engagement piece to be inserted into a first groove provided at one side of a lid portion; a second engagement portion having a second engagement piece to be inserted into a second groove at the opposite side of the lid portion; a connecting portion connecting the first engagement portion and the second engagement portion placed into the housing case together with the first and second engagement pieces to retain the housing case in a closed setting; a setting condition to retain the lid portion in a closed setting, whereby the first engagement portion and the second engagement portion are inserted in the first and the second grooves respectively, together with the connecting portion; a changing means to open the lid portion of the housing case by drawing out the first engagement piece and the second engagement piece from the first and second grooves, respectively; and a locking means to lock the changing means in a locked condition, wherein the shoplifting prevention tag is attached to the housing case in an appropriate position such that it is not easily removed from the outside of, either one of the first engagement portion, the second engagement portion or the connecting portion.

The locking means according to the present invention is released from a locked condition by means of a predetermined tool.

The shoplifting prevention tag according to the present invention is provided inside of the connecting portion.

The first and second engagement pieces according to the present invention are made to be sharpened toward their tip end portions in plate form.

The first and second engagement pieces according to the present invention are made in the form of a knife edge.

The first and second engagement portions and the connecting portions according to the present invention are made of a plastic material.

The plastic material of the first and second engagement portions and the connecting portion are transparent.

The first engagement portion and the connecting portion are affixed to each other. The changing means is structured as a detachable mechanism to remove the second engagement portion with respect to the connecting portion.

The first engagement portion and the connecting portion are fixed to each other and the changing means is structured as a slidable mechanism to slidably retain the second engagement portion with respect to the connecting portion.

The first engagement portion and the connecting portion are fixed to each other and the changing means comprises a hinge mechanism to retain the second engagement portion in either an open or closed position with respect to the connecting portion.

The connecting portion is provided with a first connecting portion which is fixed to the first engagement portion and a second connecting portion which is fixed to the second engagement portion. The changing means comprises a connecting mechanism to detachably connect the first connecting portion to the second connecting portion.

The changing means comprises a first detachable mechanism to detachably retain the first engagement portion with respect to the connecting portion and a second detachable mechanism to detachably retain the second engagement portion with respect to the connecting portion.

The material of the first engagement portion, the second engagement portion and the connecting portion is made of an elastic material and composed integrally. The changing means alternately changes the mounting and releasing condition of the first engagement portion, second engagement portion and third engagement portion.

The CD housing case is retained in a closed condition by mounting the shoplifting prevention tag cover to the housing case. Specifically, the first and second engagement pieces are inserted into the grooves provided at both sides of the lid of the CD housing case. The CD is not taken out of the housing case when the shoplifting prevention tag is attached to the housing case. The shoplifting prevention tag is also not removed from the tag cover. Accordingly, the compact disk is prevented from being shoplifted. Furthermore, as the shoplifting prevention tag cover is attached to the housing case and they are locked by the locking means, wherein the locking means requires a particularly tool to be unlocked, shoplifting prevention efficiency is further improved.

In comparison with the prior art, the tag cover of the present invention is not so large as to house the whole housing case of the compact disk, but rather, is small as to attach to a part of the housing case. Thus the shelf space required to shelve a compact disk is reduced and the efficiency of shelf space is improved.

DETAILED DESCRIPTION OF THE PREFERRED EMBODIMENTS

Now the preferred embodiment of the present invention is explained in accordance with attached drawings.

Figure 1:
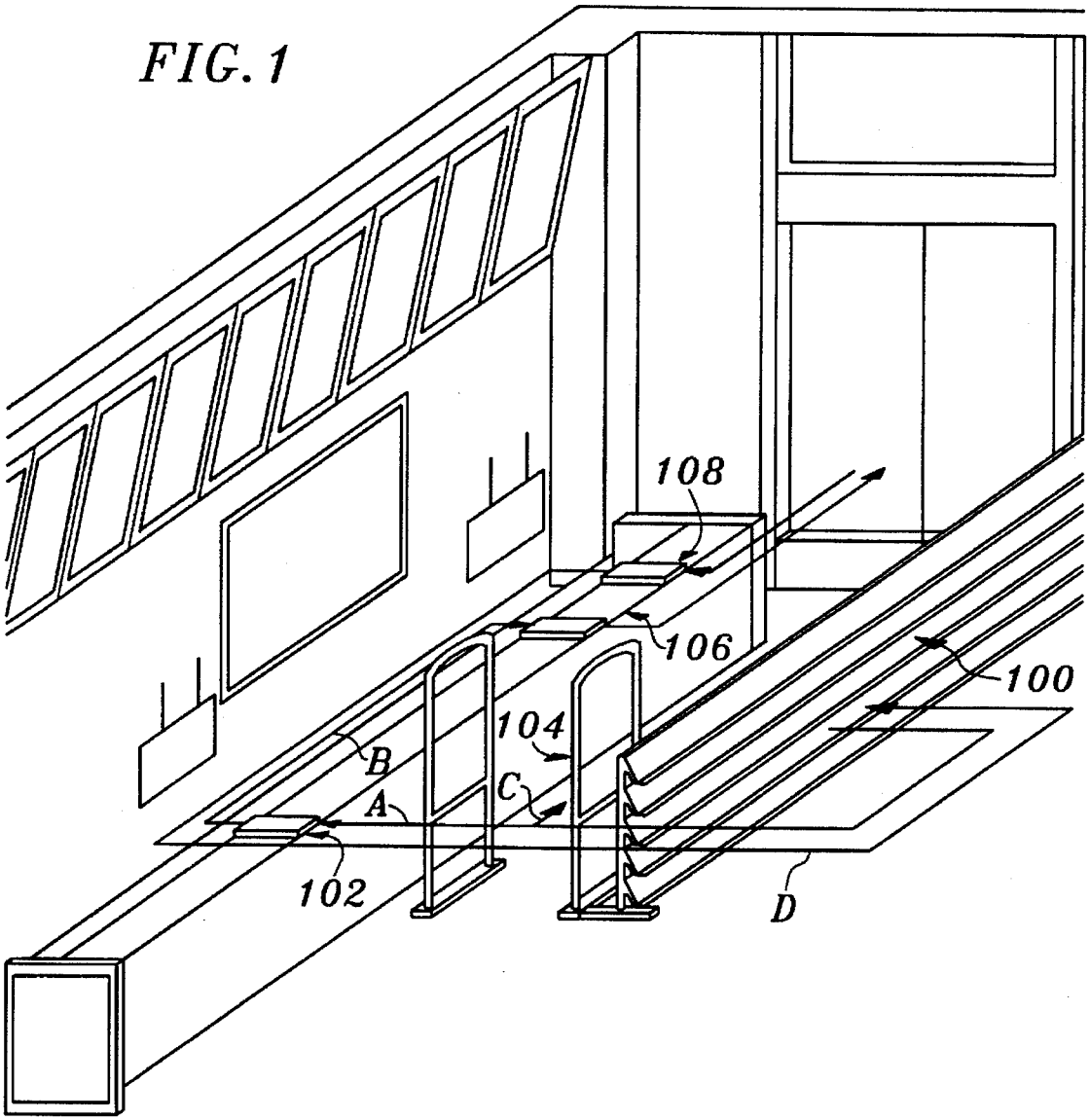
FIG. 1 is a perspective view of a general shoplifting prevention system.

FIG. 1 shows a general structure of the shoplifting prevention system provided with the shoplifting prevention tag of the present invention. This embodiment demonstrates the shoplifting prevention system applied in a video tape or CD rental shop.

In FIG. 1, reference numeral 100 indicates a display shelf located in the rental shop in which CDs, video tapes, or the like (rental soft goods) are provided with a shoplifting prevention tag. Reference numeral 102 indicates a receiving counter of the rental shop. Reference numeral 104 shows a gate. There is provided a detective device of an electric wave or electromagnetic type at the gate 104. The detective device detects the presence of a shoplifting prevention tag and if a customer goes through the gate 104 taking rental soft goods with him, the detective device will issue a warning signal.

With this shoplifting prevention system, renting and returning CDs are carried out in the following procedure. A customer takes out a CD from the shelf 100 as shown in arrow A and hands it over to the counter clerk. The clerk removes the shoplifting prevention tag from the CD and hands the CD to the customer over the rental counter 106 and the customer exits the shop.

If the customer goes through the counter gate 104 taking the CD provided with a shoplifting prevention tag with him, a warning signal is immediately issued after he passes through the gate 104 and shoplifting is thereby prevented.

When a CD or other rental soft goods are returned, the customer returns the CD at the returning counter 108 and a shoplifting prevention tag is again attached to the CD or other rental soft goods at the counter. The CD or other rental soft goods are placed back to the display shelf 100 as shown by the arrow D.

If the customer damages or removes the shoplifting prevention tag and passes through the gate, no warning signal is issued.

A preferred embodiment of the shoplifting prevention tag cover of the present invention, which makes the CD prevented from being stolen according to the aforementioned manner, is explained as follows.

Figure 2:
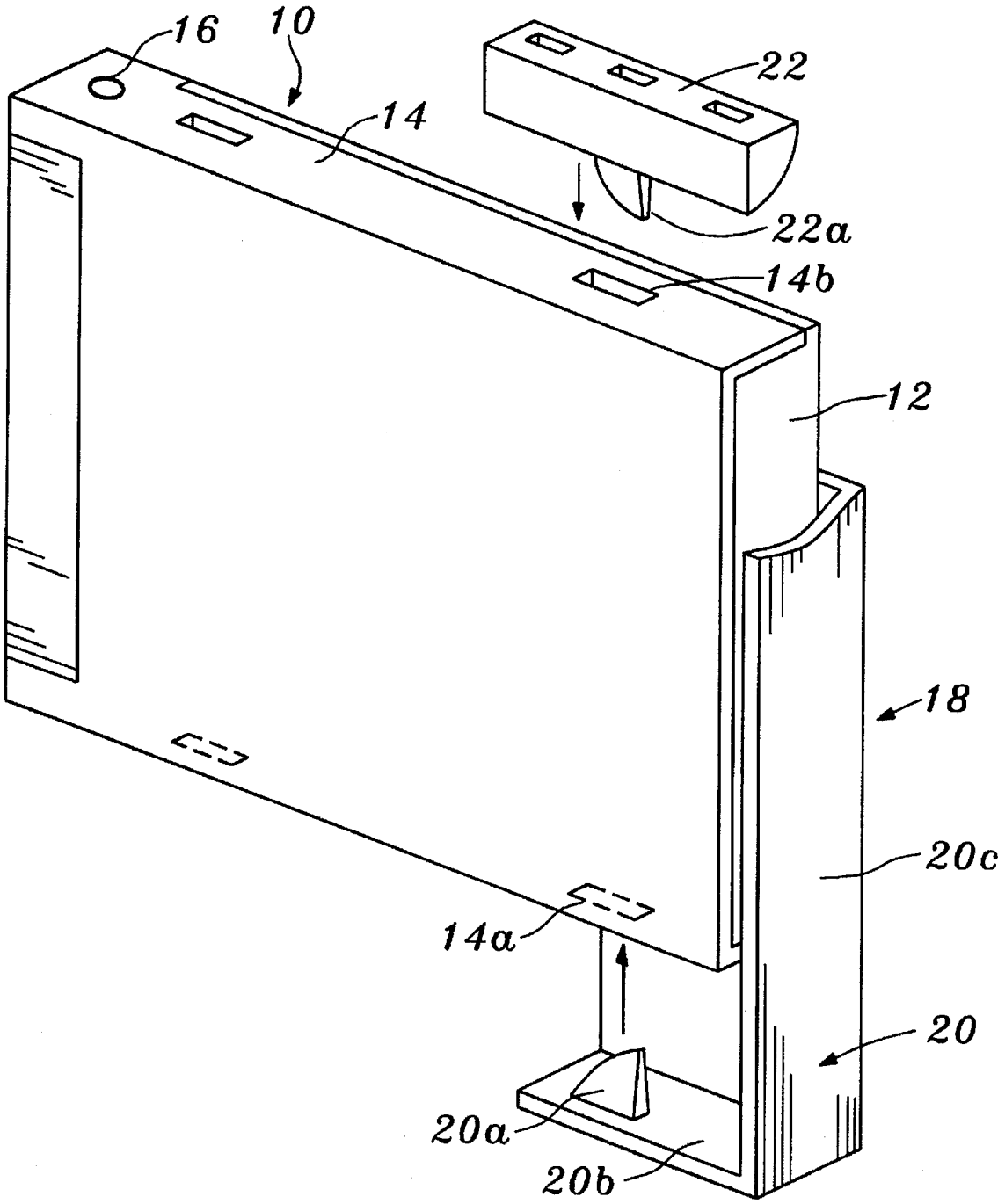
FIG. 2 is a perspective view of a compact disk housing case provided with the shoplifting prevention tag cover of the preferred embodiment of the present invention.

FIG. 2 is a perspective view showing a CD housing case 10 to be provided with a shoplifting prevention tag cover 18.

As shown in FIG. 2 an ordinary CD housing case 10 is composed of a main body 12 and a lid portion 14. The main body 12 and lid portion 14 are connected by means of a hinge 16. The main body and the lid portion are retained in either an open or closed position. There are provided on both sides of the lid portion 14 two grooves 14*a* and 14*b* of rectangular shape. These two grooves 14*a* and 14*b* are a predetermined size and are positioned at predetermined positions.

On the other hand, tag cover 18 is composed of two members made of plastic material. One member is the first member 20 having the first engagement piece 20*a* to be inserted into the groove 14*a* of the lid portion 14 and the other member is the second member 22 having the second engagement piece 22*a* to be inserted into the groove 14*b* of the lid portion 14.

The first member 20 is composed of the first engagement portion 20*b* and main body 20*c* which connects to the front and rear faces of the main body 12 of the housing case 10. The main body 20*c* is integrally composed with the first engagement portion 20*b*.

The first engagement piece 20*a* is, as shown in the figure, shaped so that it may be easily inserted to the groove 14*a* of the lid portion 14. Such shape is also convenient because it does not damage an explanation leaflet or brochure of the CD when the first engagement piece 20*a* is inserted into the groove 14*a*. Furthermore, in an ordinary CD sales store some cases 10 are wrapped with a polyvinyl sheet and such a knife edge shape of the first engagement piece 20*a* facilitates cutting into the polyvinyl sheet prior to insertion into the groove 14*a*. The tag cover 18 is considered to be applicable in a CD sales store as well as a CD rental shop.

On the other hand, the second member 22 is detachably provided in accordance with the detachable mechanism with respect to the first member 20. The second engagement piece 22*a*, provided vertically from the second member 22, is also shaped as the same knife edge as the first engagement piece 20*a* so it is possible to insert into the groove 14*b* through the polyvinyl wrapping sheet.

Figure 3:
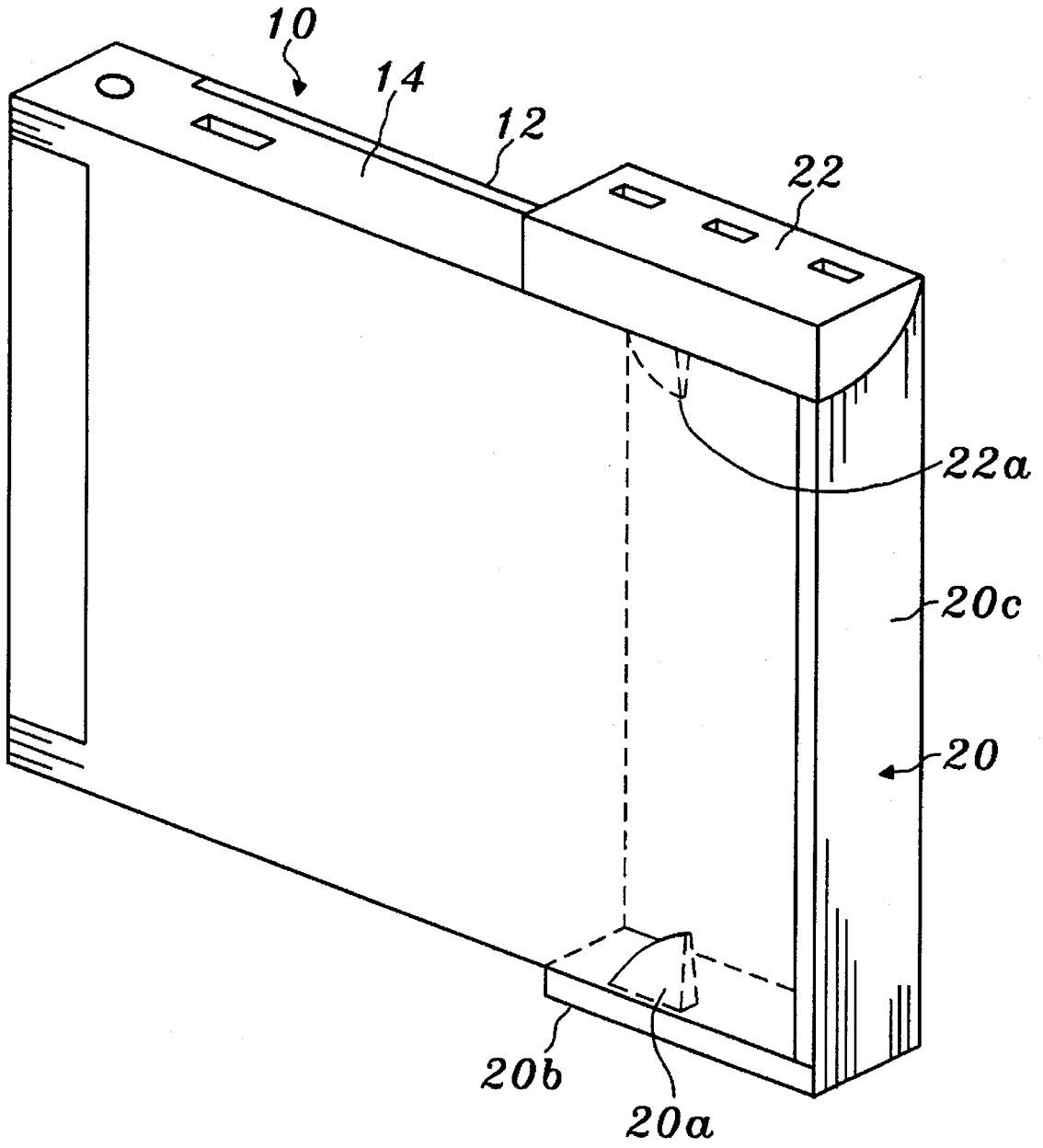
FIG. 3 is a perspective view of a CD housing case provided with the shoplifting prevention tag cover of the preferred embodiment of the present invention.

As shown in FIG. 3, the first member 20 and the second member 22 are connected to each other by means of a detachable mechanism. When the first and second members are mounted to the CD housing case as connected, the lid portion 14 of the housing case 10 is engaged with the groove 14*a* and 14*b* by means of the first engagement piece 20*a* and second engagement piece 22*a*. The main body 12 of the housing case 10 is supported by the main body 20*c* of the first member 20. Consequently, the housing case 10 is clamped by the first engagement piece 20, the second engagement piece 22*a* and the main body 20*c* of the first member 20. Thus, the lid portion 14 and the main body 12 are retained in a closed state. Accordingly, if the tag cover 18 is mounted to the housing cover 10, the CD is prevented from being taken out from the housing case 10.

Figure 4:
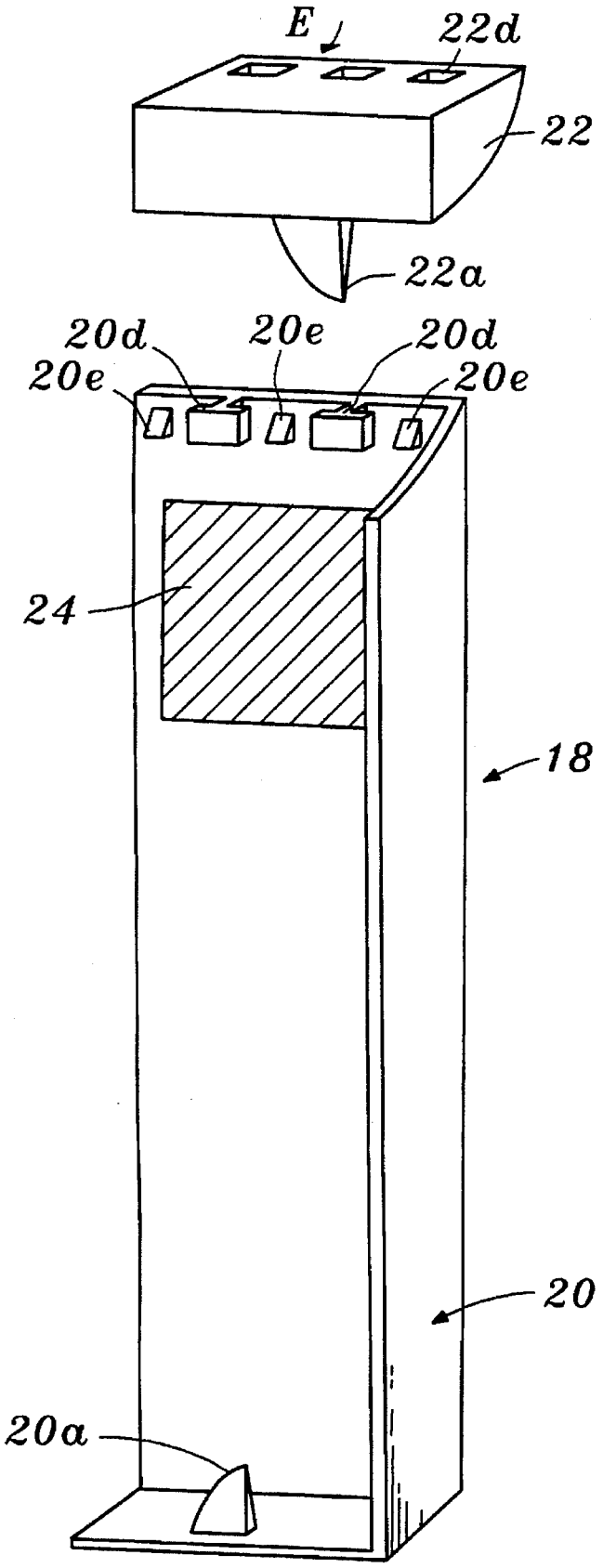
FIG. 4 is an exploded view of the tag cover.
Figure 5:
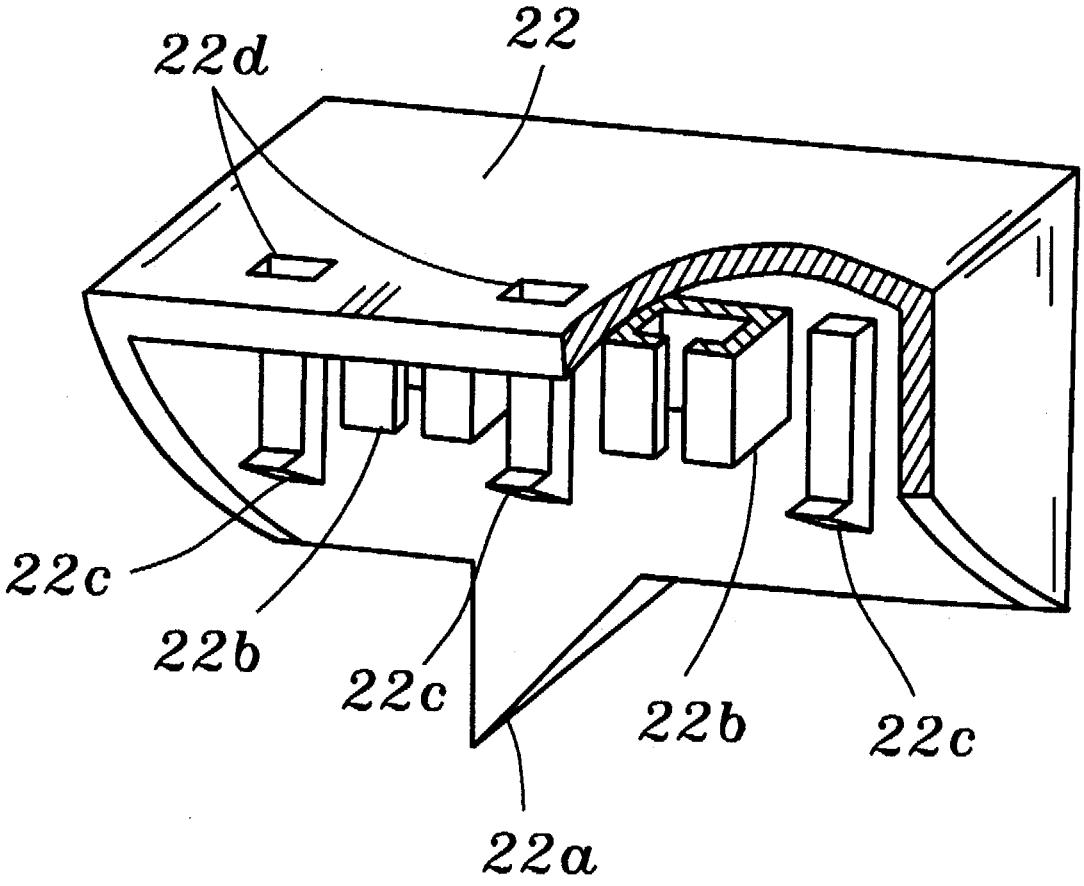
FIG. 5 is a partially cut away perspective view of the second member.

Next, FIG. 4 is a drawing to explain the structure of the tag cover 18 in detail and FIG. 5 is a rear perspective view of the second member 22.

As shown in FIG. 4, there is provided two projections 20*d* having almost a T character cross-section at an upper inside portion of the first member. There is provided an engagement projection 20*e* having triangular shaped sides disposed between the two projections 20*d*. While, as shown in FIG. 5, there are provided two fitting portions 22*b* inside the second member 22. The fitting portion is slidably fitted in the upward and downward direction with respect to the projection 20*d*. Also, there are provided engagement pawls 22*c* between the two fitting portions 22*b* and at both sides thereof. The fitting portion 22*b* fits the projection 20*d* and the engagement pawl 22*c* engages with a lower portion of an engagement projection 20*e*. The second member 22 is connected to the first member 20 and the tag cover 18 is mounted to the housing case 10 as shown in FIG. 3. The second member 22 is connected with the first member 20 by engaging the engagement pawl 22*c* of the second member 22 with the engagement projection 20*e* of the first member 20. A tool hole 22*d* located on the upper portion of the engagement pawl 22*c* of the second member 22 to release the engagement pawl 22*c* is explained afterward.

A shoplifting prevention tag 24 is provided on the upper inside of the first member 20. When the tag cover 18 is mounted to the housing case 10 the shoplifting prevention tag 24 is integrally housed in the housing case 10. The shoplifting prevention tag 24 is attached inside the tag cover 18 and the shoplifting prevention tag 24 is prevented from being removed or damaged from the outside. In order to inspect whether the shoplifting prevention tag 24 is attached to the first member 20 or not, it is preferable that the first member is made of a transparent plastic material.

Figure 6:
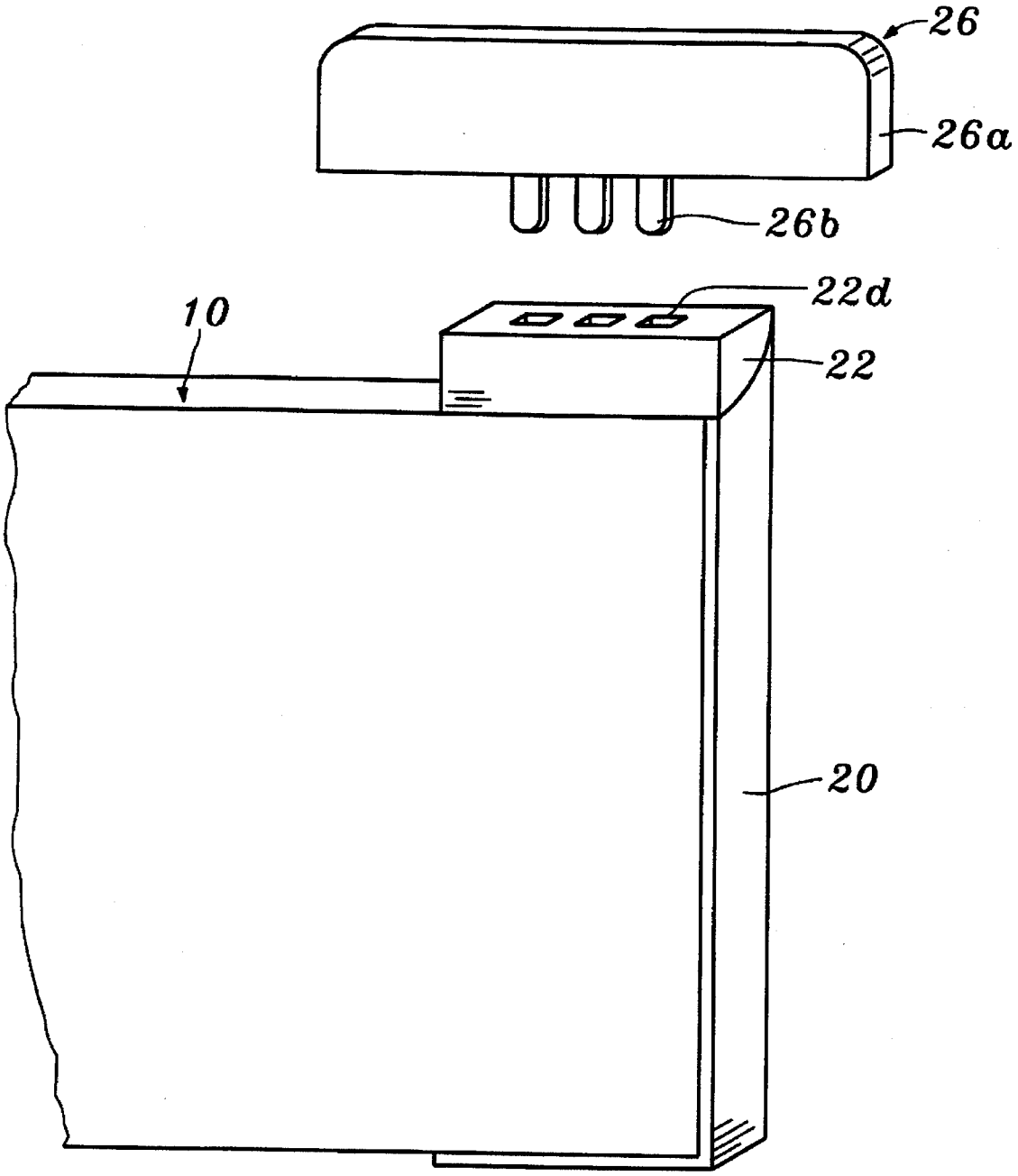
FIG. 6 is a perspective view depicting the CD case, tag cover and releasing tool according to the invention.
Figure 7A:
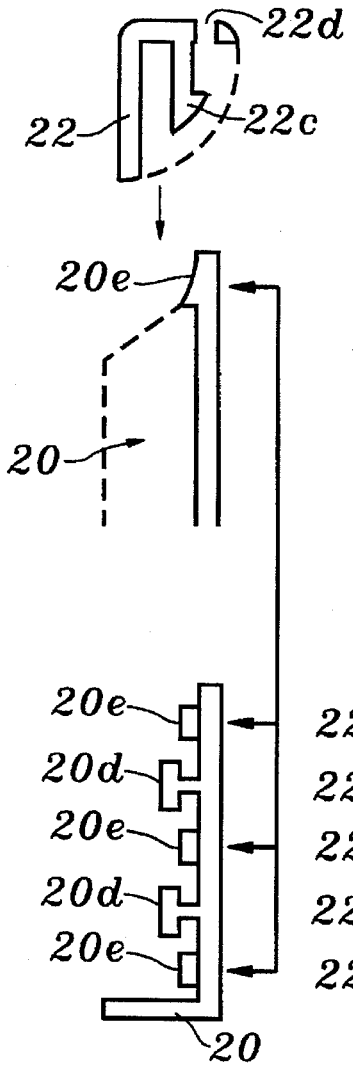
FIGS. 7*a*, 7*b*, and 7*c* depict the relative positions of the first and second member in various stages of assembly.
Figure 7B:
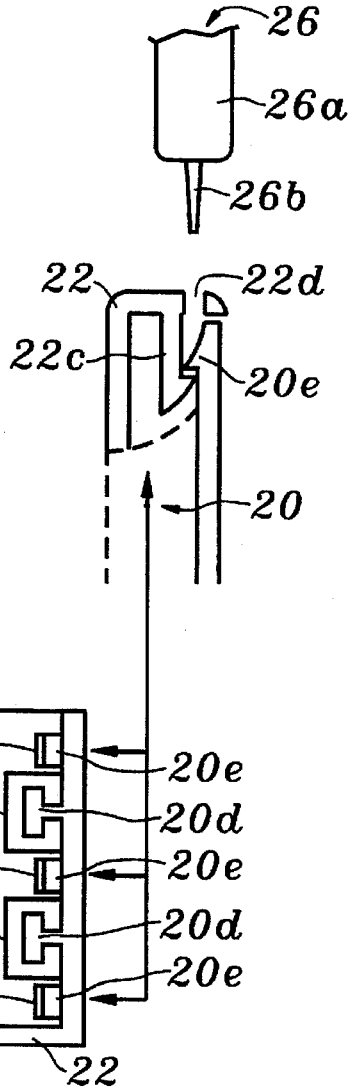
Figure 7C:
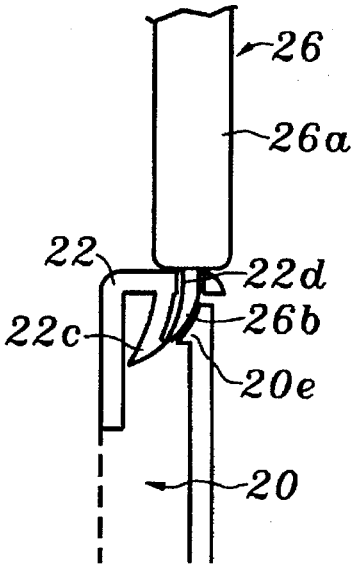

Next, FIG. 6 is a drawing of the shape of a tool to release the second member 22 from the first member 20. FIG. 7 shows how to release the second member 22 from the first member 20 by means of applying the tool shown in FIG. 6.

As shown in FIG. 6, the tool 26 is comprised of a main portion 26*a* and three push pins 26*b* vertically extending from the main portion 26*a*. The tool 26 is made of elastic material.

The second member 22 is mounted in the direction of the arrow with respect to the first member 20 from the position shown in FIG. 7(*a*). The second member 22 moves as shown in FIG. 7(*b*). The engagement pawl 22*c* engages with engagement projection 20*e*. The second member 22 is not easily removed from the first member 20. Next, the push pin 26*b* of the tool 26 is inserted to the tool hole 22*d* as shown in FIG. 7(*c*). The tip portion of the push pin 26*b* pushes tip portion of the engagement pawl 22*c*. The tip portion of the engagement pawl 22*c* is elastically deformed and the engagement pawl 22*c* and the engagement projection 20*e* are then released. Next, the second member 22 is urged upwardly and the second member 22 is released from the first member 20. According to the above mentioned structure, if the tool 26 is not applied to the second member 22 it is not easily released from the first member 20. If the tool 26 is applied, it is quite easy to release the second member 22 from the first member 20. Thus, efficient prevention of shoplifting of CDs is greatly improved by applying this particular tool.

In the above example, three push pins 26*b* are applied. But it is not limited to such number. It is, of course, conceivable to provide the tool with any number of push pins 26*b* to correspond to any number of tool holes 22*d*. In particular, it is desired to apply three or more push pins and tool holes.

Figure 8:
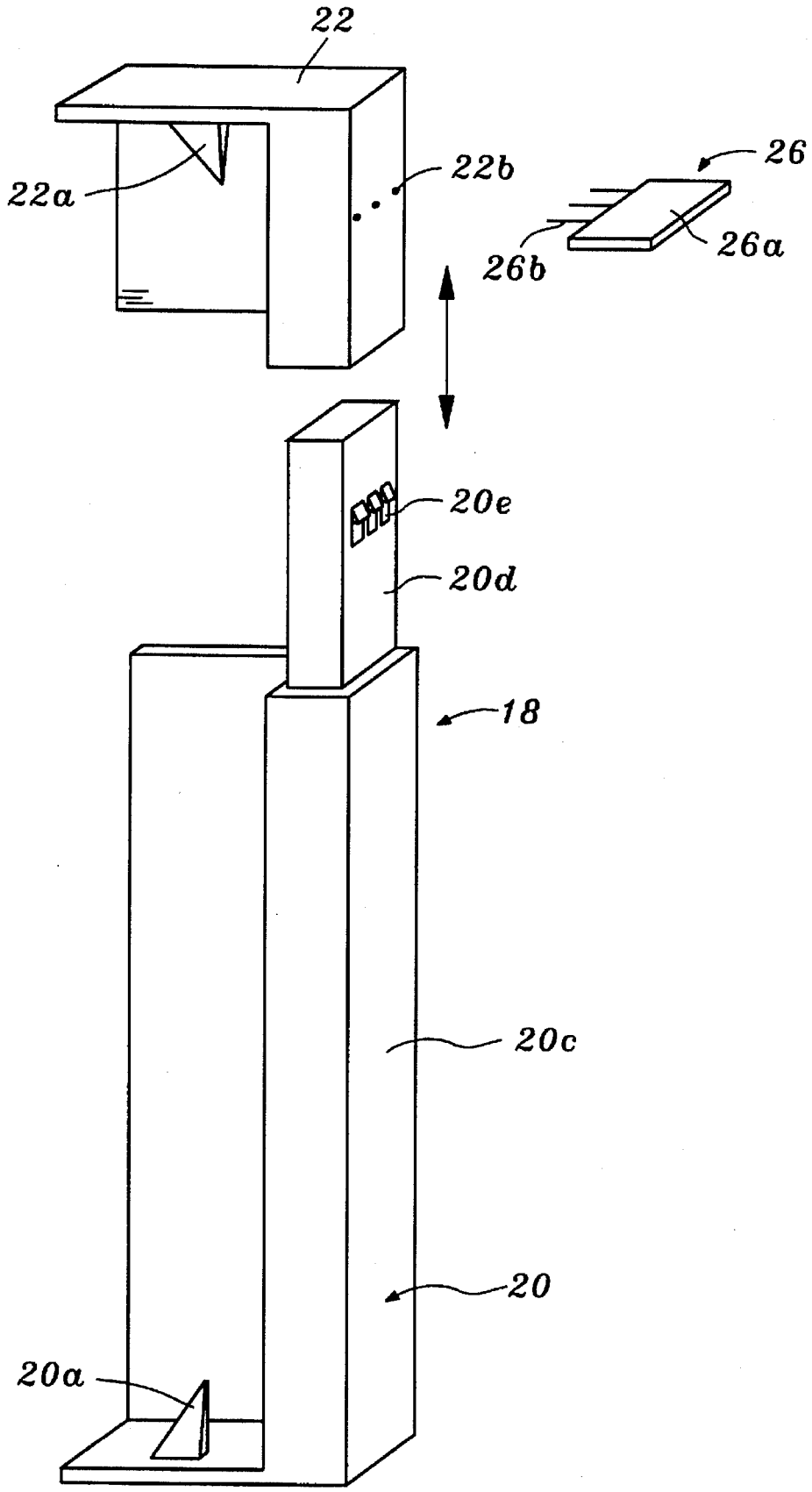
FIG. 8 is a perspective view an alternate embodiment of the present invention.
Figure 9:
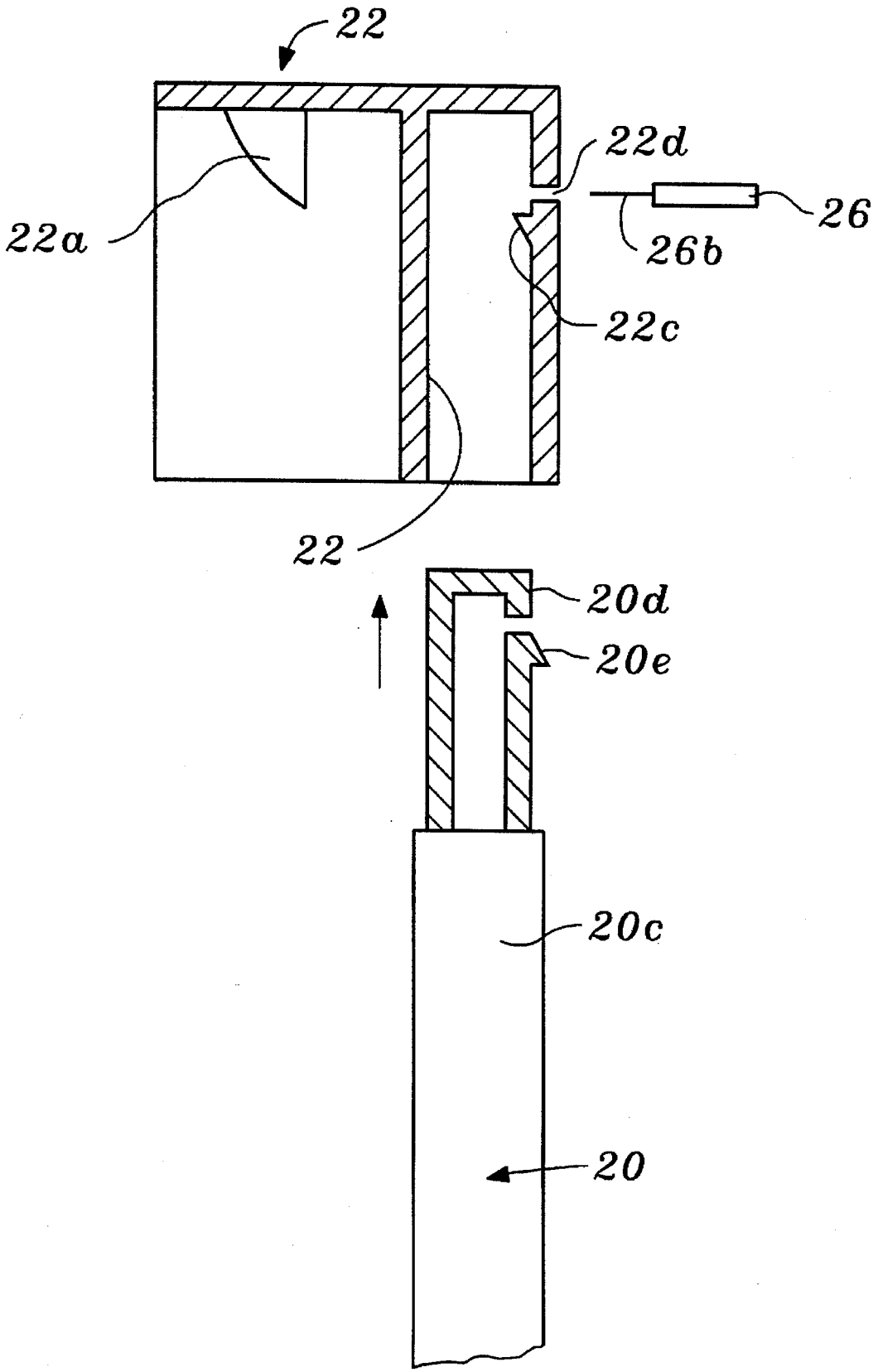
FIG. 9 is side elevation cross-sectional view of the structure of an alternative embodiment of the present invention.
Figure 10:
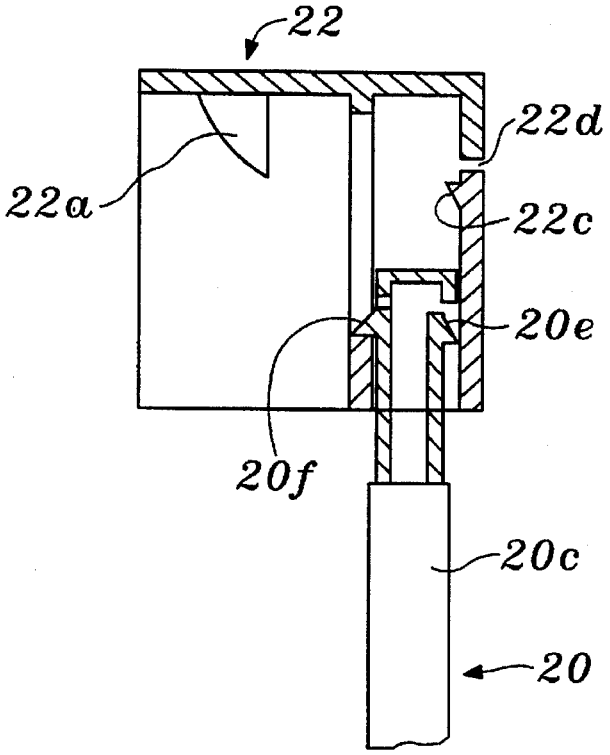
FIGS. 10–13 represent alternative embodiments of the present invention.

FIG. 8 is a perspective view showing an alternate embodiment of the present invention. FIG. 9 is a cross sectional view of the first member 20' and second member 22' shown in FIG. 8.

As shown in FIG. 8 and FIG. 9, the tag cover 18' is divided at a substantially central portion. A guide portion 20*d'* is provided on the first member 20' to slide into the second member 22*d'* in the direction indicated by the arrow shown in FIG. 8. The second member 22' is slid in the direction indicated by the arrow by fitting the guide portion 20*d'* toward the fitting holes 22*b'* to fix or detach the first member 20' with respect to the second member 22'.

There is provided three engagement pawls 20*e'* integrally formed on the outer surface of the guide portion 20*d'*. The first member 20' and the second member 22' are retained in a locked condition by engaging the engagement pawls 20*e'* with the engagement projections 22*c'* provided inside the fitting portion 22*b'*. Thus the tag cover 18' is retained firmly so that it may not be easily released from the housing case 10.

The first member 20' and the second member 22' are detachable by inserting the three push pins 26*b'*, of the tool 26', through the three tool holes 22*b'* provided on the outer surface of the second member 22. When inserted these push pins 26' push the engagement pawls 20*e'* inside to release the engagement pawls 20*e'* from the engagement projections 22*c'*.

As previously explained, a purpose of the shoplifting prevention tag cover of the present invention is to retain the CD housing case in a closed position and to prevent the CD from being stolen. The shoplifting prevention tag is not easily removed or damaged and, therefore, efficient shoplifting prevention is achieved. The tag cover is small and only attaches to a part of the CD housing case. Therefore, additional shelf space is made available.

The embodiments described and shown are illustrative, but not limitative, and can easily be modified and varied by those skilled in the art without departing from the spirit and scope of the present invention which is considered to be defined in the appended claims.

Figure 11:
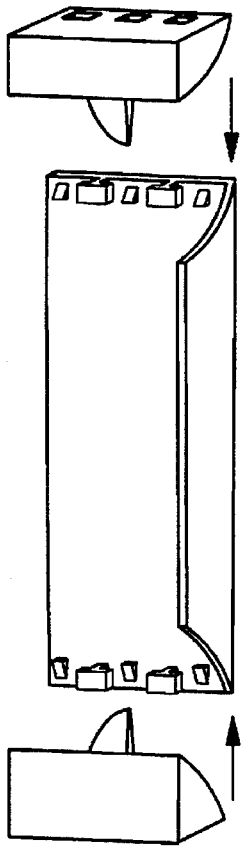

For instance, it is also recommended to divide the shoplifting prevention tag cover into three portions as shown in FIG. 11.

Figure 12:
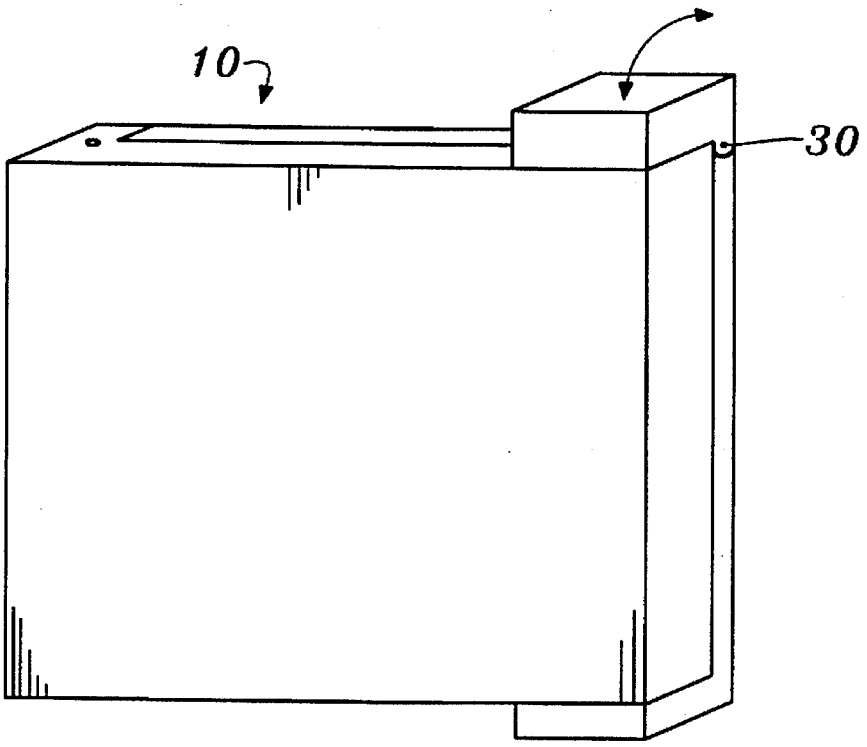

If an appropriate locking means is provided as shown in FIG. 12, the second member can be rotatably supported with respect to the first member by means of a hinge 30.

Figure 13:
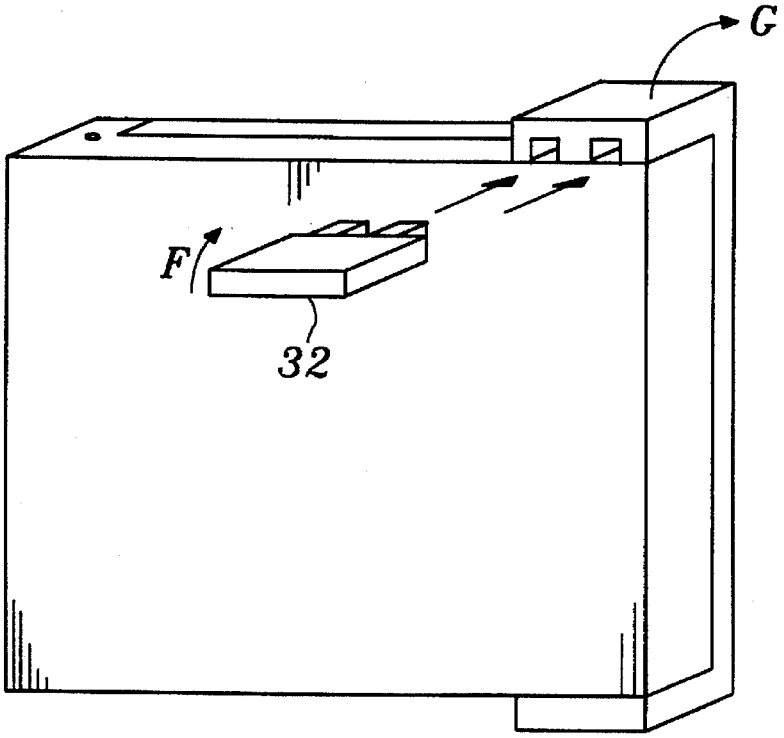

Further, as shown in FIG. 13, it is recommended to apply an elastic material to the tag cover. The tag cover is then removeably mounted to the housing case by distortion of the elastic material. In this case, a tool indicated by reference numeral 32, is applied in the direction indicated by the arrow. The tag cover is then distorted in the direction of arrow G and the tag cover is removed from the housing case 10.

As previously explained, according to the tag cover of of the present invention, the tag cover is mounted to the housing case by inserting the first and the second engagement pieces into the grooves provided at both sides of the lid portion. The shoplifting prevention tag is attached to a position of the housing case so that the tag is not easily removed from the housing case. Therefore, the compact disk and the shoplifting prevention tag are not removed from the tag cover. Accordingly, a compact disk is prevented from being shoplifted. Further, the tag cover is not released from the housing case unless a specially deviced unlocking means, developed for the purpose of unlocking the locked condition of the tag cover and the housing case, is applied. Therefore, efficient shoplifting prevention is achieved.

Unlike the prior art, the tag cover of the present invention does not house the whole housing case of the compact disk, but is attached only to a part of the housing case. The size of the tag cover is relatively small. Therefore, additional shelf space in compact disk sales stores or rental shops will be made available.

What is claimed is:

1. A compact disk tag cover for preventing shoplifting of a compact disk and associated housing having a main body and a lid portion, said lid portion having a first and second groove disposed on opposites sides of said lid portion, said tag cover comprising:

a first engagement portion having a first engagement piece adapted for insertion into said first groove;

a second engagement portion having a second engagement piece adapted for insertion into said second groove, a plurality of fitting portions, and a plurality of engagement pawls being formed on said second engagement portion, at least one of said engagement pawls being provided between two of said fitting portions;

a connecting portion connecting said first engagement portion to said second engagement portion, said connecting portion comprising a plurality of fitting projections and a plurality of engagement projections, each fitting portion detachably engaging a respective one of said fitting projections in a locked position and each engagement pawl detachably engages a respective one of said engagement projections in said locked position;

wherein, said first engagement piece and said second engagement piece in said locked position are adapted to retain said housing case in a closed state, whereby said main body and said lid portion are held close to one another such that said compact disk is prevented from being removed from said housing case;

said first engagement piece and said second engagement piece in an unlocked position are adapted to be removed from said first and second grooves such that when said first and second engagement pieces are removed from said grooves in said unlocked position said lid portion is released thereby enabling said compact disk to be removed from said housing case; and said first engagement piece and said second engagement piece each are formed as a tapered edge extending toward a tip end portion.

2. The compact disk tag cover for preventing shoplifting according to claim 1, further comprising changing means for detaching said second engagement portion from said first engagement portion to thereby change said tag cover from said locked position to said unlocked position.

3. The compact disk tag cover for preventing shoplifting according to claim 1, wherein said fitting portions engage said fitting protections in said locked position to thereby slidably retain said second engagement portion with respect to said first engagement portion.

4. The compact disk tag cover for preventing shoplifting according to claim 1, further comprising a hinge mechanism to retain said second engagement portion in one of said locked and unlocked position with respect to said first engagement portion.

5. The compact disk tag cover for preventing shoplifting according to claim 1, wherein said connecting portion is separate from a first connecting part fixed to said first engagement portion and a second connecting part fixed to said second engagement portion, and a connecting mechanism detachably connects said first connecting part and said second connecting part together.

6. The compact disk tag cover for preventing shoplifting according to claim 1, further comprising a first detachable mechanism to detachably retain said first engagement portion with respect to said connecting portion and a second detachable mechanism to detachably retain said second engagement portion with respect to said connecting portion.

* * * * *